US010707036B2

(12) United States Patent
Miyaoka et al.

(10) Patent No.: US 10,707,036 B2
(45) Date of Patent: Jul. 7, 2020

(54) ROTARY INPUT DEVICE

(71) Applicant: Panasonic Intellectual Property Management Co., Ltd., Osaka (JP)

(72) Inventors: Takeshi Miyaoka, Fukui (JP); Takuya Sasaki, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/281,992

(22) Filed: Feb. 21, 2019

(65) Prior Publication Data

US 2019/0180961 A1 Jun. 13, 2019

Related U.S. Application Data

(63) Continuation of application No. PCT/JP2017/019870, filed on May 29, 2017.

(30) Foreign Application Priority Data

Sep. 8, 2016 (JP) ..... 2016-175585

(51) Int. Cl.
*H01H 25/06* (2006.01)
*H01H 19/14* (2006.01)
(Continued)

(52) U.S. Cl.
CPC ..... *H01H 25/065* (2013.01); *G05G 5/04* (2013.01); *G05G 25/02* (2013.01); *H01H 19/14* (2013.01);
(Continued)

(58) Field of Classification Search
CPC ..... H01H 25/065; H01H 19/14; G05G 5/04; G05G 25/02
(Continued)

(56) References Cited

U.S. PATENT DOCUMENTS

2014/0071301 A1* 3/2014 Asai ..... H04N 5/2251 348/207.99

FOREIGN PATENT DOCUMENTS

JP 2003-151405 * 5/2003 ..... H01H 25/00
JP 2003-151405 A 5/2003
(Continued)

OTHER PUBLICATIONS

International Search Report of PCT application No. PCT/JP2017/019870 dated Aug. 29, 2017.

*Primary Examiner* — Edwin A. Leon
*Assistant Examiner* — Iman Malakooti
(74) *Attorney, Agent, or Firm* — Seed IP Law Group LLP

(57) ABSTRACT

A rotary input device includes: a rotary operating unit which has an operating tubular portion formed from a first material and rotationally operated, and a gripper formed from a second material which has more elasticity than the operating tubular portion, the gripper covering an outer surface of a one-end side of the operating tubular portion; a casing which has the rotary operating unit disposed therein rotatably about an axis of the rotary operating unit, and which has a locking portion for restricting a rotational range of the rotary operating unit; and an input unit which transmits a predetermined signal with the rotation of the rotary operating unit. The operating tubular portion further includes, on the other-end side thereof, a portion to be locked that has a rotational range restricted to a predetermined rotational angle by the locking portion. The operating tubular portion is provided with an extension portion that is formed from the second material integrally with the gripper, and that extends toward the other end of the operating tubular portion from the gripper. The extension portion has an abutting portion that covers at least a portion of the portion to be locked and abuts against the locking portion.

2 Claims, 6 Drawing Sheets

(51) Int. Cl.

| | |
|---|---|
| ***H01H 89/00*** | (2006.01) |
| ***H01H 25/00*** | (2006.01) |
| ***G05G 5/04*** | (2006.01) |
| ***G05G 25/02*** | (2006.01) |
| *G05G 1/02* | (2006.01) |
| *G05G 1/10* | (2006.01) |

(52) U.S. Cl.
CPC ..... *H01H 25/00* (2013.01); *H01H 89/00* (2013.01); *G05G 1/02* (2013.01); *G05G 1/10* (2013.01)

(58) Field of Classification Search
USPC ..... 200/5 R
See application file for complete search history.

(56) References Cited

FOREIGN PATENT DOCUMENTS

| | | | |
|---|---|---|---|
| JP | 2008-305693 | A | 12/2008 |
| JP | 2014-056480 | A | 3/2014 |

* cited by examiner

ROTARY INPUT DEVICE

CROSS-REFERENCE TO RELATED APPLICATIONS

This application is a continuation of the PCT International Application No. PCT/JP2017/019870 filed on May 29, 2017, which claims the benefit of foreign priority of Japanese patent application No. 2016-175585 filed on Sep. 8, 2016, the contents all of which are incorporated herein by reference.

TECHNICAL FIELD

The present invention relates to a rotary input device which includes a rotary operating unit and a locking portion for restricting a rotational range of the rotary operating unit.

BACKGROUND ART

Conventional rotary input devices include, for example, a rotary switch device in PTL 1 and a stopper structure for a rotary knob in PTL 2. The rotary switch device in PTL 1 includes: a switch body which has a cylindrical hollow rotary shaft and a switching portion that is switched by the rotation of the hollow rotary shaft; and an illuminating member having a disc shape which is provided with illuminating elements. A stopper is provided to the illuminating member, and within the hollow rotary shaft, a locking portion that abuts against the stopper with turning of the hollow rotary shaft is provided.

In addition, the stopper structure for a rotary knob in PTL 2 includes a rotary knob that is fitted to a rotary electronic component, a base that holds the rotary electronic component, and a turning member that is supported on the base so as to be turnable about the rotary shaft. A protrusion extending downward is provided on the lower surface of the rotary knob, and a protrusion is provided on the peripheral surface of the turning member.

CITATION LIST

Patent Literature

PTL 1: Unexamined Japanese Patent Publication No. 2003-151405

PTL 2: Unexamined Japanese Patent Publication No. 2008-305693

SUMMARY OF THE INVENTION

An object of the present invention is to provide a rotary input device capable of suppressing collision sound while having durability.

A rotary input device according to an aspect of the present invention includes: a rotary operating unit that has an operating tubular portion and a gripper; a casing that has a locking portion; and an input unit. The operating tubular portion is formed from a first material having a first elasticity, has a first end and a second end, and is rotationally operated. The gripper is formed from a second material with a second elasticity greater than the first elasticity, and covers an outer surface of a portion of the operating tubular portion closer to the first end than the second end is. The locking portion restricts a rotational range of the rotary operating unit. The casing holds the rotary operating unit in such a manner that the rotary operating unit is disposed rotatably about an axis of the rotary operating unit. The input unit transmits a signal corresponding to an amount of rotation of the rotary operating unit. The operating tubular portion further includes a portion to be locked and an extension portion. The portion to be locked is provided at a portion of the operating tubular portion closer to the second end than the gripper is, and restricts the rotational range of the rotary operating unit by abutting against the locking portion. The extension portion is formed from the second material integrally with the gripper, and extends toward the second end from the gripper. The extension portion has an abutting portion that covers at least a portion of the portion to be locked and abuts against the locking portion.

With this configuration, the abutting portion which is formed from the second material having elasticity and which covers the portion to be locked abuts against the locking portion, thereby reducing the occurrence of a collision sound between the portion to be locked and the abutting portion and enabling breakage or the like of these portions to be suppressed. Furthermore, the gripper covers the operating tubular portion, and the abutting portion is provided to the extension portion that extends from the gripper. Thus, the abutting portion is less likely to detach from the portion to be locked, and it is possible to maintain a reduction in collision noise and suppression of breakage.

In the rotary input device, the second material may be a thermoplastic elastomer. This configuration allows the operating tubular portion, and the gripper, the extension portion and the abutting portion to be formed by double molding, which is excellent in working efficiency. Furthermore, the abutting portion is brought into tight contact with the portion to be locked of the operating tubular portion, and suppression of collision sound and durability are maintained.

In the rotary input device, the operating tubular portion may further include a holder that is provided with a through hole extending in the extension direction of the extension portion, and the extension portion may be provided within the through hole. With this configuration, the extension portion is provided within the through hole in the holder, and thus more firmly held by the holder. Therefore, the extension portion, and the abutting portion provided to the extension portion are less likely to detach from the portion to be locked, and suppression of collision sound and durability are maintained.

The present invention offers the advantage of providing a rotary input device which has the above-described configuration, and which is capable of suppressing collision sound while having durability.

The above-described object, other objects, features, and advantages of the present invention will become apparent from the following detailed description of preferred exemplary embodiments with reference to the accompanying drawings.

DESCRIPTION OF EMBODIMENTS

Figure 1:
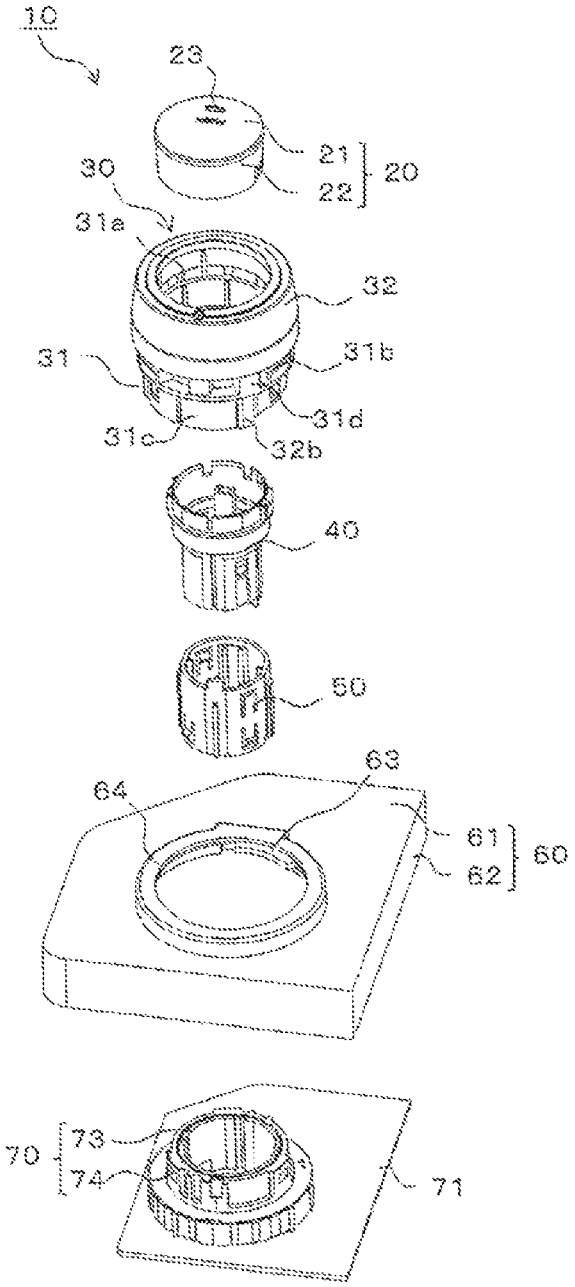
FIG. 1 is an exploded perspective view of a rotary input device according to an exemplary embodiment of the present invention.
Figure 2:
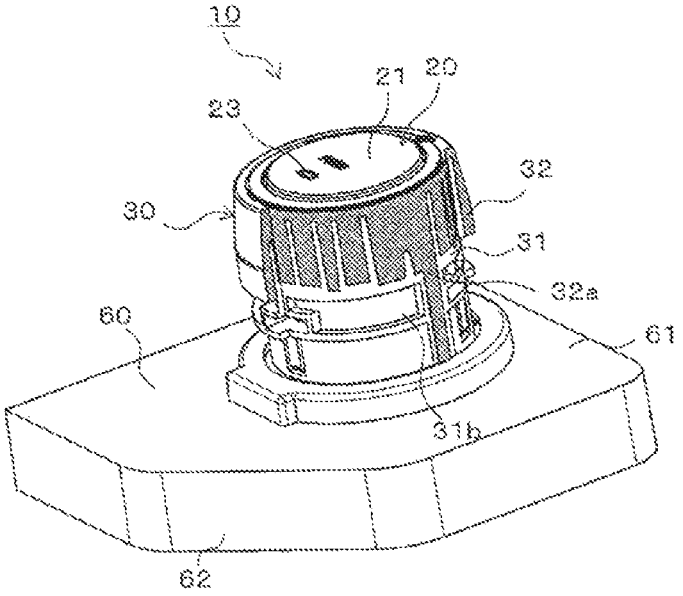
FIG. 2 is a perspective view including a partial cross-sectional view of the rotary input device.
Figure 3A:
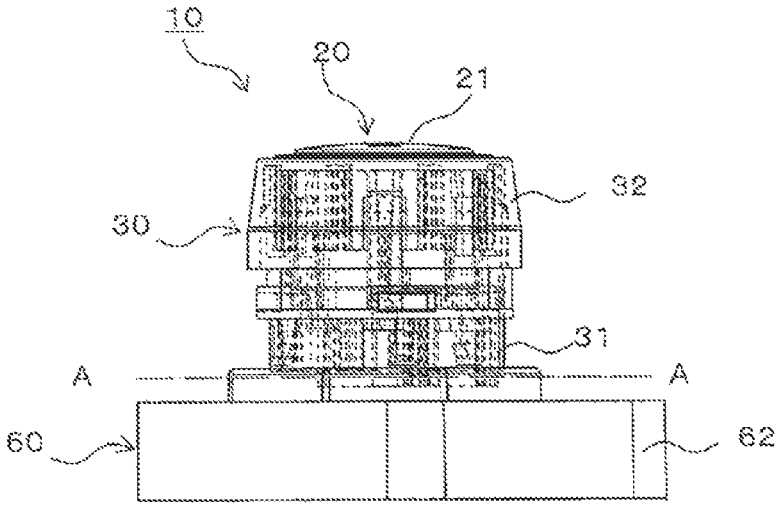
FIG. 3A is a diagram of the rotary input device viewed from the side direction.
Figure 3B:
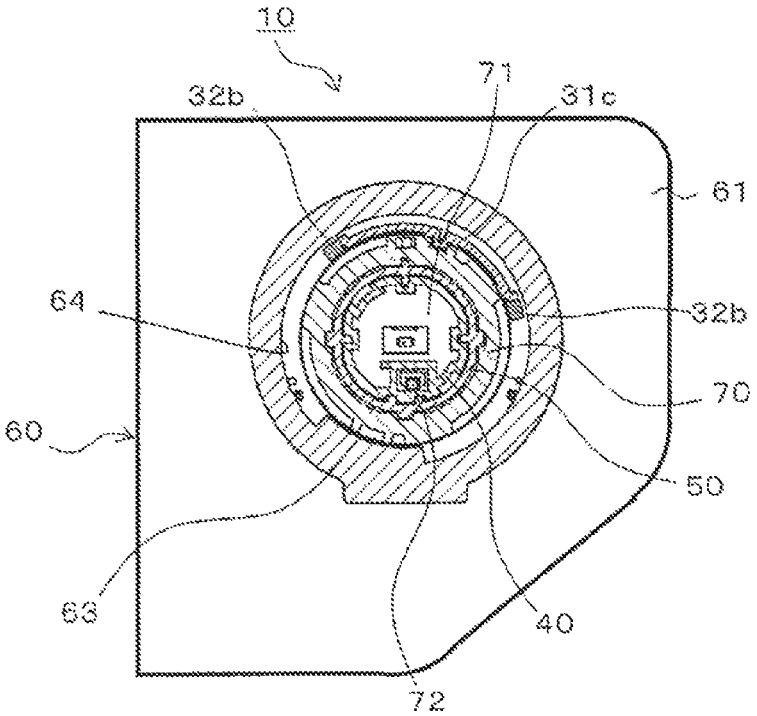
FIG. 3B is a cross-sectional view taken along line A-A in FIG. 3A.

Prior to describing exemplary embodiments of the present invention, problems found in a conventional device will be described briefly. In the rotary switch device in PTL 1 described above, the locking portion of the hollow rotary shaft abuts against the stopper of the illuminating member, thereby restricting the rotational range of the hollow rotary shaft. Furthermore, in the stopper structure in PTL 2, the protrusion of the rotary knob and the protrusion of the turning member abut against each other, thereby restricting the turning range of the rotary knob. When the rotational ranges of the hollow rotary shaft and the rotary knob are restricted in this manner, the rotary members (the locking portion of the hollow rotary shaft and the protrusion of the rotary knob) collide against the fixed members (the stopper of the illuminating member and the protrusion of the turning member).

For the collision members, a hard resin, such as ABS, is normally used in consideration of durability against collision. However, the collision between such hard resins generates a loud sound, which can cause discomfort to a user.

Hereinafter, exemplary embodiments of the present invention will specifically be described with reference to the drawings. In the following description, identical or corresponding elements depicted in all the drawings are denoted with identical reference marks; therefore, the duplicate description thereof will be omitted. For convenience of following explanation, the rotary operating unit side with respect to a casing is defined as an upper side, while the opposite side is defined as a lower side. However, the rotary input device may be installed in any orientation. For example, the rotary operating unit is not necessarily placed above the casing.

Exemplary Embodiment

Rotary input device 10 according to the present exemplary embodiment is initially described with reference to FIGS. 1 to 6B. Hereinafter, rotary input device 10 which is composed of a combination of a push button switch and a rotary switch will be described. However, rotary input device 10 may be a device which is equipped with only a rotary switch, without a push button switch. Rotary input device 10 includes push button 20, rotary operating unit 30, slide tube 40, guide tube 50, casing 60, and input unit 70.

Push button 20 has a cylindrical shape with an upper end closed, and has upper wall 21 and side wall 22.

Upper wall 21 is, for example, disc shaped and has a portion provided with illuminator 23 through which light passes. Side wall 22 is, for example, cylindrical shaped and extends downward from the outer peripheral edge of upper wall 21. Such push button 20 is fitted into first hole 31*a*, described later, of rotary operating unit 30, and at that time, side wall 22 almost entirely sinks into first hole 31*a*, but upper wall 21 is exposed to the outside from the upper end opening of first hole 31*a*.

Rotary operating unit 30 has operating tubular portion 31, and gripper 32 that covers the outer surface of one-end side (upper-end side or first end in this exemplary embodiment) of operating tubular portion 31. Operating tubular portion 31 is formed from a first material, and examples of the first material include a hard resin such as ABS, acrylic, or polycarbonate. Operating tubular portion 31 includes body 31*b*, portion 31*c* to be locked, and two holders 31*d*. Body 31*b*, portion 31*c* to be locked, and two holders 31*d* are integrally formed.

Body 31*b* is of substantially cylindrical shape having first hole 31*a*. First hole 31*a* has a columnar shape and penetrates the center of operating tubular portion 31 in the vertical direction. The axes of operating tubular portion 31 and first hole 31*a* coincide with each other and extend in the vertical direction.

Portion 31*c* to be locked is a portion extending downward from a portion of the body 31*b* and has an arc shape in a cross section orthogonal to the vertical direction. The axis of body 31*b* of cylindrical shape and the axis of portion 31*c* to be locked of arc shape coincide with each other, and the diameter of portion 31*c* to be locked is larger than the diameter of body 31*b*.

It should be noted that the shape of portion 31*c* to be locked is not limited to a continuous arc shape but may be any shape as long as both end positions of the arc shape can be defined. For example, portion 31*c* to be locked may be two portions extending downward from two places of body 31*b*. Such two portions 31*c* to be locked are provided in spaced relation to each other, and are disposed at either end of the arc shape.

Figure 4A:
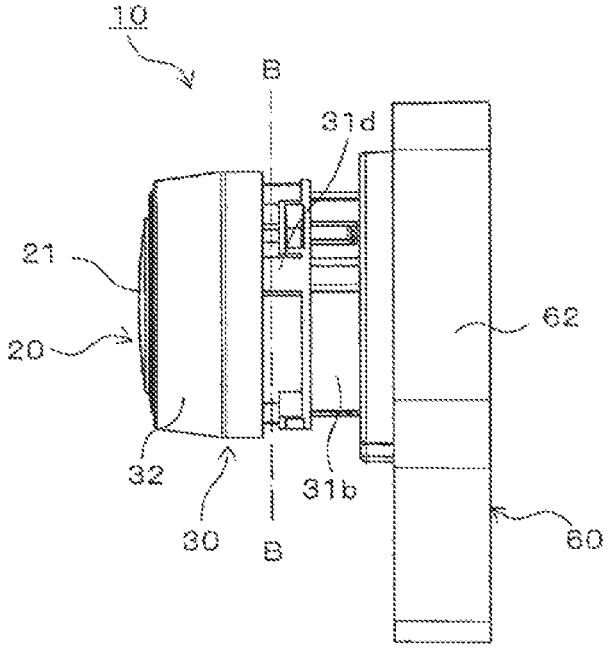
FIG. 4A is a diagram of the rotary input device viewed from the side direction.
Figure 4B:
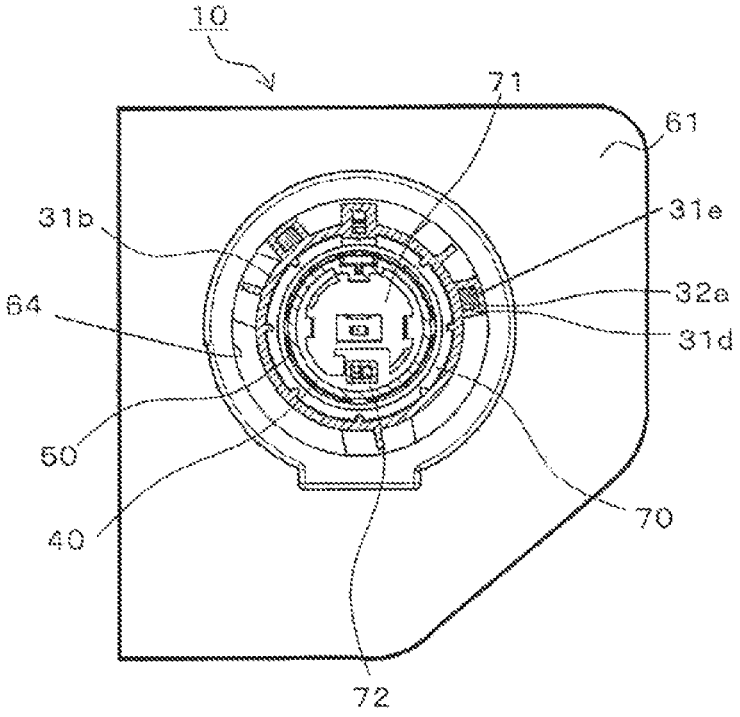
FIG. 4B is a cross-sectional view taken along line B-B in FIG. 4A.
Figure 5A:
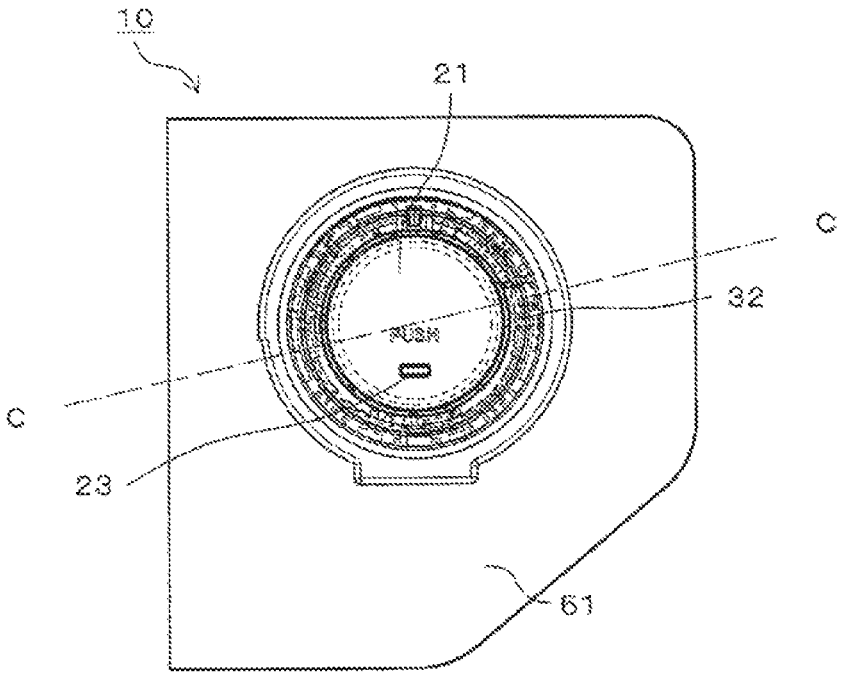
FIG. 5A is a diagram of the rotary input device viewed from above.
Figure 5B:
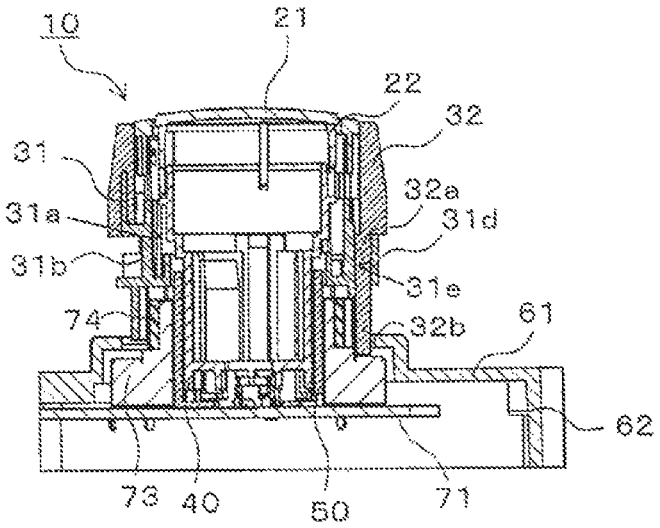
FIG. 5B is a cross-sectional view taken along line C-C in FIG. 5A.
Figure 6A:
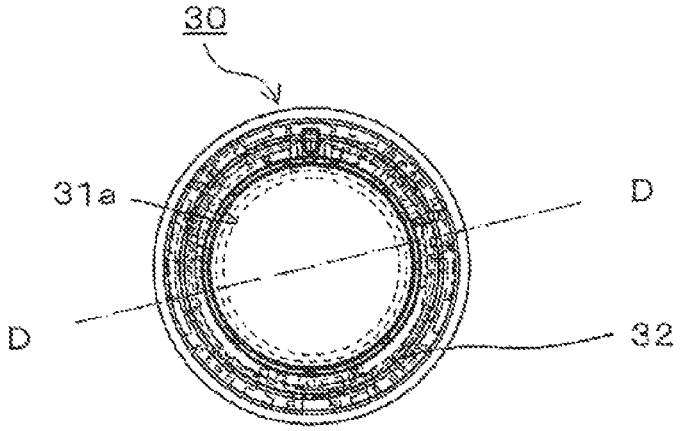
FIG. 6A is a diagram of a rotary operating unit viewed from above.
Figure 6B:
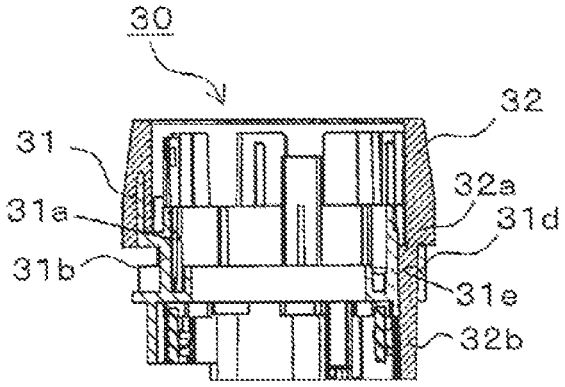
FIG. 6B is a cross-sectional view taken along line D-D in FIG. 6A.

As shown in FIG. 4B, each of holders 31*d* is provided in a protruding shape on the outer surface of body 31*b* and has second hole 31*e*. Holder 31*d* has, for example, a substantially rectangular parallelepiped shape or a substantially columnar shape, and the outer surface of holder 31*d* has an arc shape in a cross section orthogonal to the vertical direction. Two holders 31*d* are arranged above portion 31*c* to be locked, in spaced relation to each other at positions that sandwich portion 31*c* to be locked therebetween. Second hole 31*e* has a substantially rectangular parallelepiped shape or a substantially columnar shape, and is a through hole that is located lateral to body 31*b* and penetrates holder 31*d* in the vertical direction (extension direction of the extension portion).

Gripper 32 is a portion which is gripped by a user when rotary operating unit 30 is rotated. Gripper 32 is formed from the second material, such as a thermoplastic elastomer, having a second elasticity greater than a first elasticity of the first material of operating tubular portion 31. Examples of the thermoplastic elastomer include a urethane thermoplastic elastomer, a styrene thermoplastic elastomer, and an olefin thermoplastic elastomer. This material may have a flexibility greater than that of operating tubular portion 31 in addition to elasticity.

Gripper 32 has a substantially cylindrical shape, and is provided above portion 31*c* to be locked and holders 31*d* of operating tubular portion 31. Gripper 32 may cover not only the outer surface of body 31*b* of operating tubular portion 31 but also the upper end and the inner surface of body 31*b*. As a result, gripper 32 is more firmly fixed to operating tubular portion 31. It should be noted that gripper 32 may be provided with slits (FIG. 2) extending in the vertical direction. However, the slits do not reach the top of gripper 32, and the top of gripper 32 is not separated by the slits and form a substantially cylindrical shape.

Extension portion 32*a* extending toward the other end of operating tubular portion 31 (lower end or second end in this exemplary embodiment) from gripper 32 is provided on the outer surface of operating tubular portion 31. Abutting portion 32*b* is provided at the lower end of extension portion 32*a*. Gripper 32, extension portion 32*a*, and abutting portion 32*b* are integrally formed from the second material and formed, for example, by double molding in combination with operating tubular portion 31, and cover the outer surface of operating tubular portion 31 in tight contact with the outer surface of operating tubular portion 31.

Extension portion 32*a* is a portion extending downward from a portion of gripper 32, and two extension portions are provided to gripper 32. Extension portions 32*a* have a substantially plate shape or a substantially semicircular columnar shape along the outer surface of operating tubular portion 31, and reach each side of portion 31*c* to be locked of operating tubular portion 31. Extension portions 32*a* are provided within second holes 31*e* (through holes) of holders 31*d*. Thus, extension portions 32*a* are covered and held by holders 31*d*.

Abutting portions 32*b* are provided at the lower ends of extension portions 32*a* lateral to portion 31*c* to be locked. Two abutting portions 32*b* are arranged in spaced relation to each other at positions that sandwich portion 31*c* to be locked therebetween. Abutting portions 32*b* cover at least a portion of the side surface of portion 31*c* to be locked while being in tight contact with the side surface of portion 31*c* to be locked. The side surface of portion 31*c* to be locked is a surface orthogonal to the circumferential direction of operating tubular portion 31.

Slide tube 40 has a substantially cylindrical shape, and has an axis extending in the vertical direction and an upper portion to which side wall 22 of push button 20 is connected. Slide tube 40 is disposed in first hole 31*a* of operating tubular portion 31.

Guide tube 50 has a substantially cylindrical shape, and has an axis extending in the vertical direction and an interior into which slide tube 40 is inserted so as to be movable in the vertical direction with respect to guide tube 50. Guide tube 50 is disposed in first hole 31*a* of operating tubular portion 31 and fixed to input unit 70.

Casing 60 has rotary operating unit 30 disposed therein rotatably about the axis of rotary operating unit 30, and has locking portion 63 for restricting the rotational range of rotary operating unit 30. Casing 60 is formed from a hard resin such as ABS, acrylic, polycarbonate. Casing 60 has a box shape having an internal space and opening downward and has upper wall 61 and side wall 62. Upper wall 61 is, for example, a substantially pentagonal plate-shaped body, and has opening 64 at the center thereof. Opening 64 has a circular shape and penetrates upper wall 61. The diameter of opening 64 is larger than the diameter of rotary operating unit 30, and the lower end of body 31*b* is disposed spaced apart from the edge of the upper portion of opening 64. Side wall 62 extends downward from the outer peripheral edge of upper wall 61.

Locking portion 63 is provided at the lower portion of opening 64 and protrudes inward from the inner edge of the lower portion of opening 64, and has an arc shape in a direction orthogonal to the vertical direction. The inner periphery of locking portion 63 is provided parallel to the inner edge of opening 64, and the center of locking portion 63 having an arc shape coincides with the center of opening 64. Portion 31*c* to be locked is disposed in the region on the inside of the lower portion of opening 64 where locking portion 63 is not provided, and the rotation of portion 31*c* to be locked causes abutting portion 32*b* covering portion 31*c* to be locked to abut against locking portion 63.

Input unit 70 is disposed on printed substrate 71 and electrically connected to the electronic circuit on printed substrate 71. Input unit 70 is, for example, a potentiometer, and performs conversion into a predetermined signal corresponding to the rotation amount of either the rotational angle or the movement amount of rotary operating unit 30 to output the signal to the electronic circuit on printed substrate 71. Input unit 70 has fixed tubular portion 73 and rotary tubular portion 74, both of which have a cylindrical shape, and the axes of fixed tubular portion 73 and rotary tubular portion 74 extend in the vertical direction and coincide with each other. Fixed tubular portion 73 is disposed inside rotary tubular portion 74 and fixed to printed substrate 71. Rotary tubular portion 74 is held by fixed tubular portion 73 so as to be rotatable with respect to fixed tubular portion 73.

Printed substrate 71 is provided in the internal space of casing 60, and fixed tubular portion 73 and rotary tubular portion 74 pass through opening 64 of casing 60 and protrude upward from upper wall 61 of casing 60. Guide tube 50 is fixed to fixed tubular portion 73 by the snap-in method or the like. Operating tubular portion 31 of rotary operating unit 30 is fixed to rotary tubular portion 74. Light emitter 72 is disposed inside fixed tubular portion 73. Furthermore, light emitter 72 and a switch (not shown) are arranged on printed substrate 71, and the switch turns light emitter 72 on or off according to the vertical movement of slide tube 40.

Next, a description will be given of the use of rotary input device 10. When the user pushes push button 20, slide tube 40 connected to push button 20 moves downward with respect to guide tube 50 on the inside of guide tube 50. This movement is detected by the switch, and light emitter 72 emits light. The light from light emitter 72 passes through the interior of slide tube 40 and reaches push button 20 to illuminate illuminator 23 of push button 20.

Furthermore, when the user grips gripper 32 and rotates rotary operating unit 30, rotary operating unit 30 is rotated around slide tube 40 and guide tube 50 within opening 64 of casing 60. With this rotation, rotary tubular portion 74 of input unit 70 connected to rotary operating unit 30 rotates. Input unit 70 detects the rotational angle or the movement amount of rotary tubular portion 74, and outputs a predetermined signal corresponding the rotational angle or the movement amount to the circuit of printed substrate 71.

When portion 31*c* to be locked of rotary operating unit 30 abuts against locking portion 63 of casing 60 during the rotation of rotary operating unit 30, the rotational range of rotary operating unit 30 is restricted. Here, if rotary operating unit 30 is rotated largely, portion 31*c* to be locked collides with locking portion 63 with abutting portion 32*b* interposed therebetween. At this time, abutting portion 32*b*, which is an elastic body, absorbs the collision energy, thereby allowing a reduction in the occurrence of sound due to collision. Further, by absorbing the collision energy with abutting portion 32*b*, it is possible to reduce the propagation of the collision energy to locking portion 63 and portion 31*c* to be locked, and prevent the breakage of locking portion 63 and portion 31*c* to be locked due to the collision.

As described above, according to rotary input device 10 having the above-described configuration, abutting portion 32*b* which covers portion 31*c* to be locked suppresses collision sound between portion 31*c* to be locked and locking portion 63 and improves the durability of these portions.

Furthermore, abutting portion 32*b* is provided on extension portion 32*a* extending from gripper 32. Gripper 32, extension portion 32*a*, and abutting portion 32*b* are integrally formed. In addition, abutting portion 32*b*, extension portion 32*a*, and gripper 32 are formed by double molding in combination with operating tubular portion 31 and brought into tight contact with operating tubular portion 31. Further, extension portion 32*a* passes through second hole 31*e* of holder 31*d*, and is covered and held by holder 31*d*. Thus, even when locking portion 63 and portion 31*c* to be locked collide with each other, abutting portion 32*b* is less likely to detach from portion 31*c* to be locked, and thus suppression of collision sound and improvement of durability are maintained.

Further, by using a thermoplastic elastomer for abutting portion 32*b*, extension portion 32*a*, and gripper 32, it is possible to form operating tubular portion 31 and abutting portion 32*b*, extension portion 32*a* and gripper 32 by double molding. Therefore, it is unnecessary to form and assemble operating tubular portion 31 and abutting portion 32*b*, extension portion 32*a* and gripper 32, and the operation efficiency is excellent.

Other Exemplary Embodiments

In the above-described exemplary embodiment, portion 31*c* to be locked is provided on the outer surface of operating tubular portion 31, and locking portion 63 is provided on the inner surface of opening 64 of casing 60. Alternatively, portion 31*c* to be locked may be provided on the inner surface of operating tubular portion 31, and locking portion 63 may be provided on the outer surface of opening 64 of casing 60. Also in this case, with the same configuration as that in the above-described exemplary embodiment, rotary input device 10 can exert the same operations and effects as in the above exemplary embodiment.

Further, in the above-described exemplary embodiment, extension portion 32*a* is provided on the outer surface of operating tubular portion 31, but may be provided on the inner surface of body 31*b* of operating tubular portion 31. In this case, the diameter of portion 31*c* to be locked is formed to be smaller than that of body 31*b* so that abutting portion 32*b* of extension portion 32*a* is located lateral to portion 31*c* to be locked. Thus, extension portion 32*a* extends toward the lower end from gripper 32 on the inner surface of operating tubular portion 31 so that abutting portion 32*b* can cover portion 31*c* to be locked.

Further, in this case, holder 31*d* having second hole 31*e* extending in the extension direction of extension portion 32*a* may be provided in a protruding shape on the inner side of body 31*b*. Thus, extension portion 32*a* extends toward the lower end on the inner surface of operating tubular portion 31 and passes through second hole 31*e* of holder 31*d*, and thus is covered and held by holder 31*d*.

Furthermore, in the above-described exemplary embodiment, extension portion 32*a* is formed in a linear shape, but the shape of extension portion 32*a* is not limited thereto. For example, extension portion 32*a* may be bent such that abutting portion 32*b* is located further toward the inside than gripper 32. On the contrary, extension portion 32*a* may be bent such that abutting portion 32*b* is located further toward the outside than gripper 32.

Further, in the above-described exemplary embodiment, two extension portions 32*a* are provided such that two abutting portions 32*b* reach each side of portion 31*c* to be locked. Alternatively, one extension portion 32*a* may be provided such that one abutting portion 32*b* reaches one side of portion 31*c* to be locked. This allows abutting portion 32*b* to cover at least one side of portion 31*c* to be locked.

Any of the exemplary embodiments described herein may be combined as long as no incompatibility is produced between one another. It is apparent from the foregoing description that those skilled in the art will conceive various modifications and other exemplary embodiments on the present invention. It is accordingly understood that the foregoing description is merely interpreted as being illustrative and is given for the purpose of teaching those skilled in the art the best mode for carrying out the present invention. It is therefore possible to substantially change the details of at least one of the structure and function of the present invention without departing from the spirit of the present invention.

INDUSTRIAL APPLICABILITY

The rotary input device of the present invention is useful as a rotary input device or the like capable of suppressing collision sound while having durability.

REFERENCE MARKS IN THE DRAWINGS

10: rotary input device
20: push button
21: upper wall
22: side wall
23: illuminator
30: rotary operating unit
31: operating tubular portion
31*a*: first hole
31*b*: body
31*c*: portion to be locked
31*d*: holder
31*e*: second hole
32: gripper
32*a*: extension portion
32*b*: abutting portion
40: slide tube
50: guide tube
60: casing
61: upper wall
62: side wall
63: locking portion
64: opening
70: input unit
71: printed substrate
72: light emitter
73: fixed tubular portion
74: rotary tubular portion

The invention claimed is:

1. A rotary input device comprising:

a rotary operating unit that includes an operating tubular portion and a gripper, the operating tubular portion comprising a first material with a first elasticity and rotationally operated, the operating tubular portion having a first end and a second end, the gripper comprising a second material with a second elasticity greater than the first elasticity, the gripper covering an outer surface of a portion of the operating tubular portion, the portion being closer to the first end than the second end;

a casing that includes a locking portion for restricting a rotational range of the rotary operating unit, the casing holds the rotary operating unit in such a manner that the rotary operating unit is disposed rotatably about an axis of the rotary operating unit; and an input unit that transmits a signal corresponding to an amount of rotation of the rotary operating unit, wherein the operating tubular portion further comprising:

a portion to be locked that is provided at a portion of the operating tubular portion closer to the second end than the gripper, and restricts the rotational range of the rotary operating unit by abutting against the locking portion;

an extension portion integral the gripper and formed of the second material, the extension portion extends toward the second end from the gripper, the extension portion having an abutting portion, the abutting portion covering and abutting at least a portion of the portion to be locked, and the abutting portion configured to abut against the locking portion; and a holder, the holder having a through hole that extends in an extension direction of the extension portion, the extension portion being provided within the through hole.

2. The rotary input device according to claim 1, wherein the second material is a thermoplastic elastomer.

* * * * *